United States Patent [19]

Pufpaff et al.

[11] Patent Number: 4,583,654

[45] Date of Patent: Apr. 22, 1986

[54] PLASTIC HOLE PLUG

[75] Inventors: Frederick J. Pufpaff, Loudonville; John M. Maloney, Mechanicville, both of N.Y.

[73] Assignee: Simmons Fastener Corporation, Albany, N.Y.

[21] Appl. No.: 746,512

[22] Filed: Jun. 19, 1985

[51] Int. Cl.[4] ..... B65D 39/00

[52] U.S. Cl. ..... 220/307; 220/DIG. 19; 215/355

[58] Field of Search ..... 220/307, DIG. 19; 215/355; 217/98, 108, 110

[56] References Cited

U.S. PATENT DOCUMENTS 4,334,632 6/1982 Watanabe ..... 220/307

4,363,420 12/1982 Andrews ..... 220/307

4,413,748 11/1983 Kessler et al. ..... 220/307

*Primary Examiner*—George T. Hall

*Attorney, Agent, or Firm*—Eliot S. Gerber

[57] ABSTRACT

A plastic resin hole plug to fill a hole in a flat thin panel comprises a one-piece unitary injection-molded plastic member having a top dome closure wall whose bottom surface has a flat ledge which rests on the panel and an undercut ring. The plug has a tubular shank portion which extends from the top closure wall portion and whose outer face retains the plug in the hole. The shank's outer face has a first circumferential band canted inwardly and a second circumferential band joined thereto which is canted outwardly. At least one, and preferably two, side flats are formed on the shank portion, which flats flex inward when the plug is inserted into the hole.

7 Claims, 5 Drawing Figures

PLASTIC HOLE PLUG

BACKGROUND OF THE INVENTION

The present invention relates to industrial fasteners and more particularly to a plastic hole plug (closure plug).

In the manufacture of various panels, especially rigid thin plastic panels and sheet metal panels, holes are formed in the panel to be filled by a screw, rivet or other fastener. However, frequently the holes are left empty. For example, a refrigerator wall or an automotive body panel may be punched or drilled with holes which are used to attach devices. If the devices are omitted, for example, the device may be an optional device which is not selected, the panel would be left with an empty hole. It is often desirable that the hole be closed, so that the panel may have a better appearance and to prevent the passage of moisture or dirt.

A hole plug, to be acceptable, must be able to be retained in the panel, for example, it should stay in its hole even though the panel may vibrate or objects may be bumped against the plug. The plug must be able to fit in holes which are not exactly round and in holes which are "off-size", i.e., either too big or too little for the exact diameter of the plug. Furthermore, in a sheet metal panel the panel hole edge may have a sharp metal burr which may prevent the easy insertion of the plug into the hole. Some hole plugs, which are satisfactory in other respects, may be expensive because they utilize an excessive amount of plastic resin or because their design requires expensive manufacturing techniques.

OBJECTIVES AND FEATURES OF THE INVENTION

It is an objective of the present invention to provide a plastic hole plug which will fit into a round hole in a metal panel even though the hole has a burr on its edge.

It is a further objective of the present invention to provide such a hole plug which may be inserted into a hole with relatively consistent snap-in pressure even though the holes may differ slightly in diameter, i.e., the holes are "out of tolerance".

It is a further objective of the present invention to provide such a hole plug which may be economically manufactured using conventional machinery and techniques and will be firmly retained in its hole and resist accidental dislodgment from its hole.

It is a feature of the present invention to provide a hole plug which is a unitary one-piece injection-molded plastic resin member. It is adapted to fit into a hole in a panel, even if the hole has a burr, and to fit into holes that differ slightly in their diameters. The hole plug has a top wall portion whose top face is domed, i.e., it is a sector of a sphere. The top wall portion terminates, at its outer edge of the top face, in a curved lip. The top wall portion has a bottom support ledge which is adapted to rest on the panel face.

The hole plug also has a tubular shank portion extending from the top wall portion and having an imaginary central axis. The shank portion has an inner wall and an outer wall. The outer wall has, as contiguous ring-like circumferential bands, a first band contiguous to the top wall portion and canted outwardly (relative to the axis); a second band contiguous to said first band and canted inwardly toward the axis from its juncture with the first band; and a pair of opposed and parallel flat portions so that it may fit, with consistent snap-in force, in holes which have slightly different diameters. The flat portions extend through the first and second bands and are on opposite sides of the outer wall.

BRIEF DESCRIPTION OF THE DRAWINGS

Other objectives and features of the present invention will be apparent from the following detailed description, taken in conjunction with the accompanying drawings. In the drawings.

DETAILED DESCRIPTION OF THE INVENTION

Figure 1:
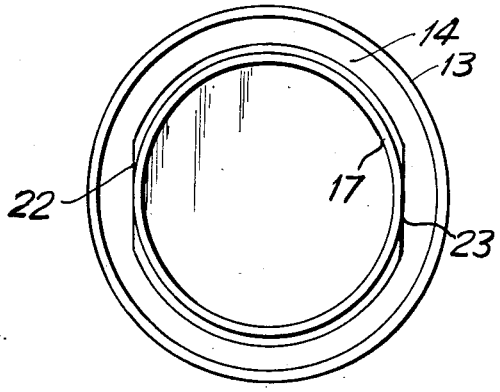
FIG. 1 is a bottom plan view of the hole plug of the present invention.
Figure 2:
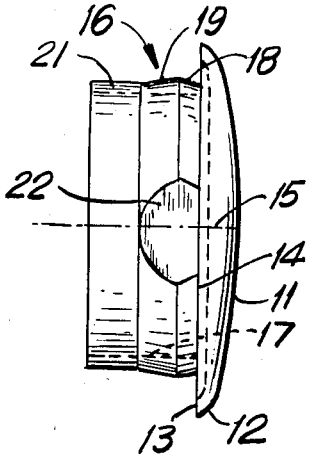
FIG. 2 is a side plan view of the hole plug of FIG. 1.
Figure 3:
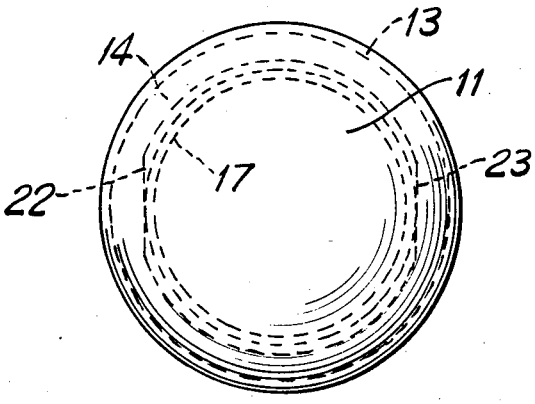
FIG. 3 is a top plan view of the hole plug of FIG. 1.
Figure 4:
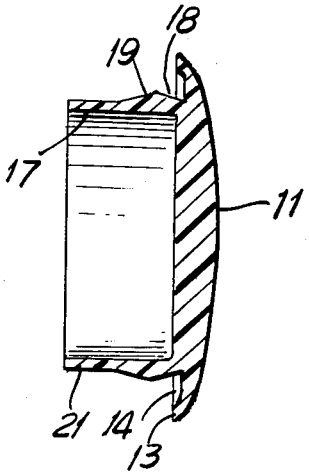
FIG. 4 is a cross-sectional view of the hole plug of FIG. 1 taken along line A—A of FIG. 1 looking in the direction of the arrows.

The present invention is of a hole plug 10, shown in FIGS. 1–3, which is formed as a unitary one-piece member from molten plastic resin by injection-molding. The design of the hole plug 10 permits a plurality, for example 12, plugs to be molded simultaneously in one mold, permitting high-speed production. The hole plug is formed with relatively thin walls, so as to economize the use of the plastic resin, and yet is relatively strong because of its design. The plastic resin is somewhat flexible and the preferred plastic resin is polyethylene.

As shown in FIGS. 1–3, the hole plug 10 has a top wall 11 which is dome-shaped. The dome wall 11, in the preferred embodiment, is formed on a center of 3.03 inches, i.e., it is a circular segment of a sphere having a diameter of 6.06 inches. The dome wall 11 has an edge lip 12 formed on a radius. The lip 12 leads to a circular ledge 13 which is adjacent a flat undercut ring 14, preferably 0.02 inch undercut. The ledge 13 and undercut ring 14 are flat and perpendicular to the imaginary central axis 15 of the plug 10.

A generally tubular shank portion 16 extends from the dome wall 11. The internal wall 17 of the tubular portion 16 is straight, forming a right-handed cylinder, which has a diameter of 0.770 inch in the preferred embodiment.

The outer wall 20 of the tubular portion 16 has a slanted circumferential ring 18, i.e., a canted wall in cross-section perpendicular to the axis, preferably 0.078 inch in width, and with an angle of preferably 18°, relative to axis 15. The first ring 18 is canted inward toward the top toward the dome wall 11, to grip the panel. The outer surface ring 18 meets a ring 19 (second ring) whose cant is outwardly directed, preferably at a 21° angle inwardly, from the joint line 20. The ring 19 provides a lead-in for insertion into the panel hole.

The second ring 19 is contiguous to the bottom ring portion 21 of the outer wall 20 of the shank portion. The bottom ring portion is a straight right-sided cylindrical wall preferably 0.830 inch in diameter.

Two flat portions 22 and 23 are formed on opposite sides of the outer wall 20. The flats 22 and 23 are parallel flat portions having a preferred diameter of 0.835 inch across. The flat portions 22 and 23 permit the plug 10 to be flexed inwardly, by finger pressure, bowing upwardly the dome wall 11, and allowing the plug to be inserted into a panel hole which has a burr.

Figure 5:
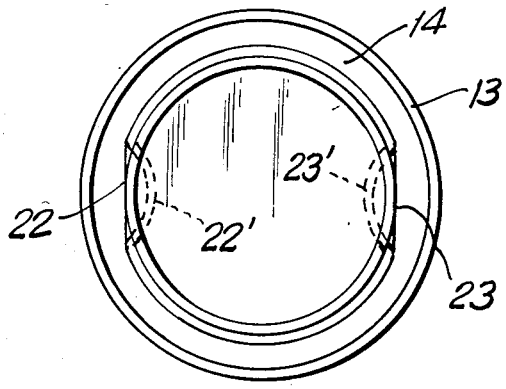
FIG. 5 is a bottom plan view, similar to FIG. 1, but illustrating the inward flexing of the side flats with dot-dash lines.

As shown in FIG. 5, the flat portions 22 and 23 are bowed inwardly, at 22' and 23', when the plug is inserted into a hole. The amount of bowing is somewhat exaggerated in FIG. 5, for clarity of the operation. Such bowing (flexing) action permits the plug to be inserted, with a consistent pressure from one plug to another, into holes having slightly different diameters, i.e., holes that are "out of tolerance". Although the hole plug illustrated has two opposed flat portions, it will be understood that the hole plug may, alternatively, have one flat portion, or three or four flat portions.

What is claimed is:

1. A hole plug which is a unitary one-piece injection-molded plastic resin member adapted to fit into a hole in a panel comprising:

a top closure wall portion whose top face is domed, said top wall portion terminating at its outer edge of the top face in a curved lip and having a bottom support ledge portion which is adapted to rest on the panel face;

a tubular shank portion extending from the top wall portion and having an imaginary central axis, an inner wall and an outer wall;

said outer wall having, as contiguous ring-like circumferential bands, a first band contiguous to the top wall portion and canted outwardly from said axis starting at its juncture with the top closure wall, a second band contiguous to said first band and canted inwardly toward the axis from its juncture with the first band; and a pair of opposed and parallel flat portions on said outer wall to permit inward flexing of the hole plug, the flat portions extending through said first and second bands and being on opposite sides of said outer wall.

2. A hole plug as in claim 1 and further comprising, as a portion of the tubular outer wall portion, a right-sided cylindrical band contiguous to the second band.

3. A hole plug as in claim 1 wherein said ledge portion is flat and in a plane perpendicular to said axis.

4. A hole plug as in claim 1 wherein the inner wall of the tubular portion is a right-sided cylinder whose center is at said axis.

5. A hole plug as in claim 1 and further comprising an undercut circumferential ring between said ledge and said first band.

6. A hole plug which is a unitary one-piece injection-molded plastic resin member adapted to fit into a hole in a panel comprising:

a top wall portion whose top face is domed and is a sector of a sphere, said top wall portion terminating at its outer edge of the top face in a curved lip and having a bottom support ledge portion which is adapted to rest on the panel face, said ledge portion being flat;

a tubular shank portion extending from the top wall portion and having an imaginary central axis, an inner wall and an outer wall;

said outer wall having, as contiguous ring-like circumferential bands, a first band contiguous to the top wall portion and canted outwardly from said axis starting at the juncture with the top closure wall, a second band contiguous to said first band and canted inwardly toward said axis from its juncture with the first band, and a third band contiguous to said second band and being a right-sided cylindrical straight-walled band; and a pair of opposed and parallel flat portions on said outer wall to permit inward flexing of the hole plug, the flat portions extending through said first and second bands and being on opposite sides of said outer wall.

7. A hole plug which is a unitary one-piece injection-molded plastic resin member adapted to fit with uniform snap-in force into holes in panels where the holes have slightly different diameters, comprising:

a top closure wall portion whose top face is domed, said top wall portion terminating at its outer edge of the top face in a curved lip and having a bottom support ledge portion which is adapted to rest on the panel face;

a tubular shank portion extending from the top wall portion and having an imaginary central axis, an inner wall and an outer wall;

said outer wall having, as contiguous ring-like circumferential bands, a first band contiguous to the top wall portion and canted outwardly from said axis starting at its juncture with the top closure wall, a second band contiguous to said first band and canted inwardly toward the axis from its juncture with the first band; and at least one flat portion on said outer wall which bends inward when the plug is inserted into a hole, the flat portion extending through said first and second bands.

* * * * *